US006311377B1

(12) United States Patent
Krueger

(10) Patent No.: US 6,311,377 B1
(45) Date of Patent: Nov. 6, 2001

(54) APPARATUS AND METHOD FOR SPREADING FIBROUS TOWS INTO LINEAR ARRAYS OF GENERALLY UNIFORM DENSITY AND PRODUCTS MADE THEREBY

(75) Inventor: Ronald G. Krueger, New Braunfels, TX (US)

(73) Assignee: Owens Corning Fiberglass Technology, Inc., Summit, IL (US)

( * ) Notice: Subject to any disclaimer, the term of this patent is extended or adjusted under 35 U.S.C. 154(b) by 0 days.

(21) Appl. No.: 09/067,669

(22) Filed: Apr. 28, 1998

(51) Int. Cl.[7] ..... D01D 11/02

(52) U.S. Cl. ..... 28/282; 282/65 T; 26/87; 26/102

(58) Field of Search ..... 26/102, 87; 28/282; 19/65 T

(56) References Cited

U.S. PATENT DOCUMENTS

| | | | |
|---|---|---|---|
| 2,244,203 | | 6/1941 | Kern . |
| 2,610,957 | | 9/1952 | Steinman et al. . |
| 3,041,230 | | 6/1962 | Diehl . |
| 3,132,986 | | 5/1964 | Goldman . |
| 3,148,102 | | 9/1964 | Eakins et al. . |
| 3,723,235 | | 3/1973 | Armstrong . |
| 3,737,950 | | 6/1973 | Bolliand et al. . |
| 3,785,904 | | 1/1974 | Watson . |
| 3,808,639 | * | 5/1974 | Tautvaisas . |
| 3,930,091 | | 12/1975 | Lewis et al. . |
| 3,934,064 | | 1/1976 | Lowthian . |
| 3,943,805 | * | 3/1976 | Lubitzsch . |
| 4,211,818 | | 7/1980 | Ackley . |
| 4,220,496 | | 9/1980 | Carley et al. . |
| 4,220,497 | | 9/1980 | Carley . |
| 4,405,669 | | 9/1983 | Pott . |
| 4,421,584 | | 12/1983 | Kitagawa et al. . |
| 4,507,164 | | 3/1985 | Pott . |
| 4,647,326 | | 3/1987 | Pott . |
| 4,690,850 | | 9/1987 | Fezio . |
| 4,713,134 | | 12/1987 | Mays et al. . |
| 4,800,114 | | 1/1989 | Cichanowski . |
| 4,851,274 | | 7/1989 | D'Elia . |
| 4,851,277 | | 7/1989 | Valkenberg et al. . |
| 4,870,887 | | 10/1989 | Tresselar et al. . |
| 4,883,551 | | 11/1989 | Britton . |
| 4,935,077 | | 6/1990 | Ellers . |
| 5,022,952 | | 6/1991 | Vaniglia . |
| 5,181,330 | | 1/1993 | Schoch . |
| 5,232,533 | | 8/1993 | Tani et al. . |
| 5,556,690 | | 9/1996 | Katz . |
| 5,569,344 | | 10/1996 | Grimnes . |

FOREIGN PATENT DOCUMENTS

| | | |
|---|---|---|
| 15691/66 | 6/1969 | (AU) . |
| 491356 | 6/1992 | (EP) . |
| 554312B1 | 7/1995 | (EP) . |
| 2175614A | 12/1986 | (GB) . |
| WO 98/11010 | 3/1998 | (WO) . |

* cited by examiner

*Primary Examiner*—Elizabeth M. Cole
(74) *Attorney, Agent, or Firm*—Inger H. Eckert

(57) ABSTRACT

A process and apparatus for spreading fibers in a fibrous tow provides a fiber spreader for spreading a tow of fibers moving in a machine direction having a plurality of spaced pins, where the spacing between the pins is variable relative to the machine direction, and the position of the pins is variable relative to the machine direction. Variation of the spacing and position of the pins during motion of the pins contact with a tow moving generally in the machine direction provides a spread tow of lower, more uniform areal weight for further use in product applications. Variation in pin spacing and fiber spreading results from rotation of at least one pin relative to another after the pins are inserted into a tow. Alternate techniques for fiber spreading and additional features for stress relief of fibers during the fiber spreading operation are disclosed.

22 Claims, 17 Drawing Sheets

APPARATUS AND METHOD FOR SPREADING FIBROUS TOWS INTO LINEAR ARRAYS OF GENERALLY UNIFORM DENSITY AND PRODUCTS MADE THEREBY

CROSS REFERENCE TO RELATED APPLICATION

This application is related to contemporaneously filed U.S. patent application Ser. No. 09/067,667, entitled "Apparatus and Method for Making a Fabric," by Ronald G. Krueger, the disclosure of which is hereby incorporated by reference.

BACKGROUND OF THE INVENTION

The present invention relates to the production of more uniform fabrics, and in particular, to the spreading of fibrous tows or zero-twist yarns used in producing woven and non-woven fabrics. In the fabric industry, particularly the reinforcing and structural fabric industry, rovings and zero twist yarns are used in weaving or stitching fabrics. Such fabrics then are used in many ways, including reinforcement of polymers or the creation of honeycomb reinforcements or supports.

Methods have long been sought to weave lighter weight webs of materials to reduce weight and cost. However, conventional production processes are limited in their ability to create lightweight webs of generally uniform areal weight. Several such processes disclosed in U.S. Pat. Nos. 4,556,440 and 4,667,831 dispose segments of a roving side by side to make a layer of material in a reinforcement fabric. However, the fabric varies randomly in areal weight along its length depending on how uniformly the fibers in the roving are spread across the weaving machine. Improvements which more uniformly spread the fibers of rovings used in fabrics would desirably reduce weight and cost, and more efficiently use the strength of the fibers. Such reinforcement fabrics are further used in the production of honeycomb materials which would similarly benefit from more uniformly spread fibers in the fabric layers which make up the honeycomb.

Fiber spreading processes are known in which rovings or zero twist yarns (both also referred to as tows) are resin impregnated and passed over a series of highly polished rolls to spread the width of the tow. Such methods for spreading fibers rely on the impregnant providing greater lubricity between fibers in the tow. Other methods of pneumatically opening fibrous tows are known in the art. However, the fibers so opened are only temporarily spread to permit the addition of a coating or other material, and are recombined into a tow.

Accordingly, the need exists to provide apparatuses and processes to more uniformly spread the fibers in a tow for use in existing apparatuses, processes and products.

SUMMARY OF THE INVENTION

The present invention satisfies that need with a fiber spreading process and apparatus which is capable of spreading a tow to provide a tow, web or ribbon of spread fibers having a lower areal weight. Input rovings or zero-twist yarns may be spread in-line in weaving or other fabric forming operations, or off-line in preparation for weaving or other fabric forming operations. In any event, spread fiber tows, webs or ribbons produced in accordance with the present invention will permit the production of fabrics having lower areal weight.

In accordance with the present invention, a process for spreading fibers is disclosed comprising the steps of moving an input tow of fibers generally in a machine direction along a tow path, contacting the tow with a plurality of spaced pins and moving the pins in the machine direction with the tow, then varying the spacing of the pins relative to the machine direction, and spreading the tow of fibers from a first areal density to a second areal density. After spreading the tow, the pins are removed from contact with the tow, which remains in a more uniform, spread condition.

A fiber spreader apparatus is further disclosed in accordance with the present invention. The fiber spreader spreads a tow of fibers moving in a machine direction, and comprises a plurality of spaced pins, where the spacing between the pins is variable relative to a machine direction, and the position of the pins is variable relative to the machine direction. The spacing and position of the pins are variable when the pins are moved generally in the machine direction. As a result, a tow moving in the machine direction along a tow path defined through the apparatus may be contacted by the pins, and spread by varying the spacing of the pins during such contact into a more uniform tow.

In addition, the present invention further includes a tow having a second areal density spread from a first input tow, where the second areal density is a lower, more uniform areal density. In accordance therewith, the spread fiber tow may also be a generally flat ribbon, or a web which is coated, treated or pre-impregnated, or may be adhered to a web of other material.

These and other objects and features of the present invention will become apparent from the drawings and detailed description below.

DETAILED DESCRIPTION OF THE PREFERRED EMBODIMENTS

Figure 1:
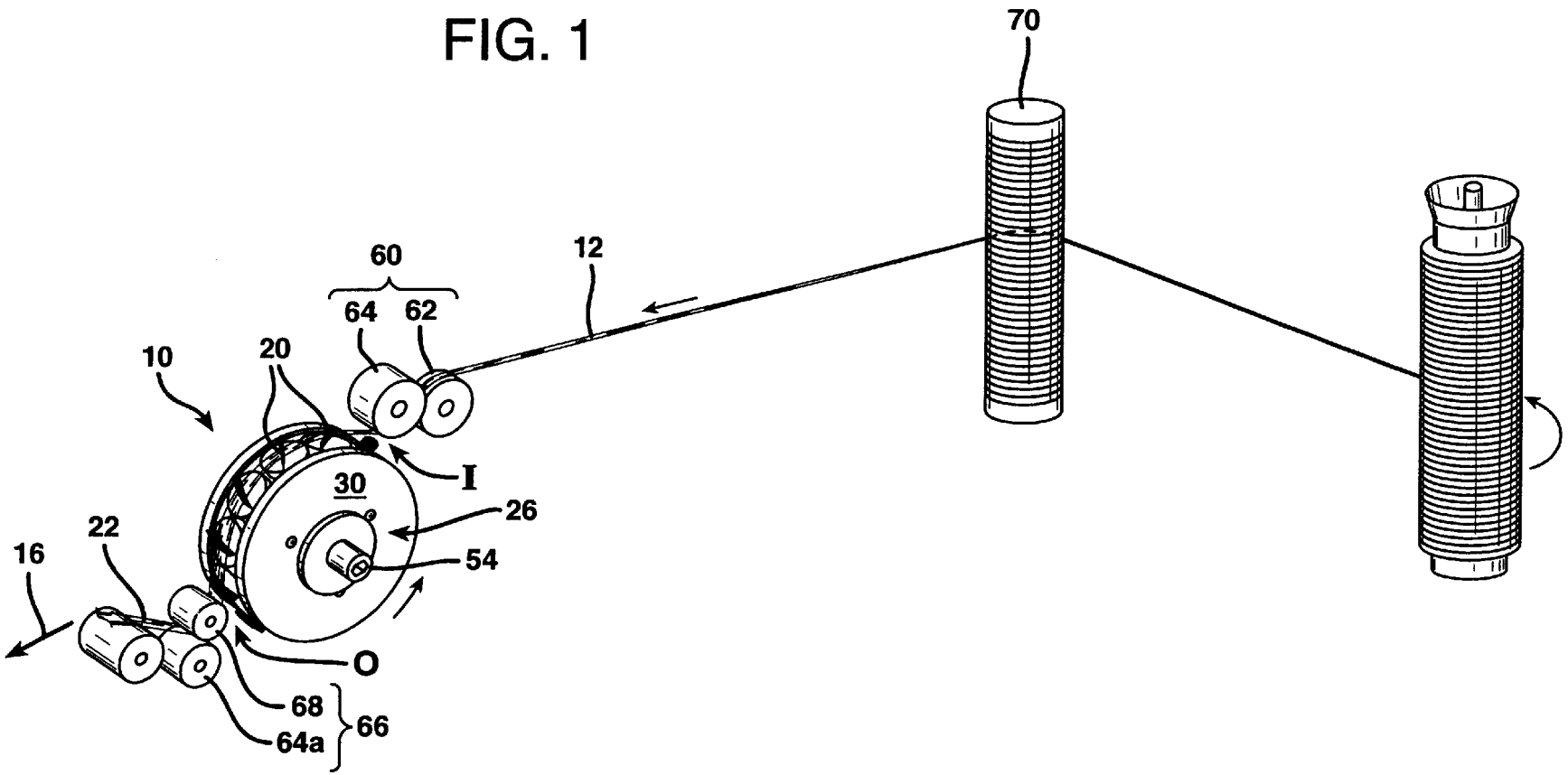
FIG. 1 is a schematic perspective view of the preferred embodiment of the present invention.

Referring to FIGS. 1–6, the preferred process for spreading fibers using fiber spreader 10 may be understood. The preferred process includes the steps of moving an input tow 12 of fibers 14 generally in a machine direction 16 along a tow path 18 (see FIG. 3), and contacting the tow at an initial point of contact, I, with a plurality of spaced pins 20. Contact between the pins and the tow causes the pins to move in the machine direction. The process then calls for varying the spacing, S, of the pins relative to the machine direction (see FIG. 4), and spreading the input tow of fibers from a first areal density to become a second tow 22 having a second, lower and preferably more uniform areal density (see FIG. 4). After spreading the tow, the pins are retracted from contact with the tow, which remains in a more uniform, spread condition. Several rollers, described in greater detail below, are provided to help align the input tow and maintain the spread fibers in the second tow.

Figure 5:
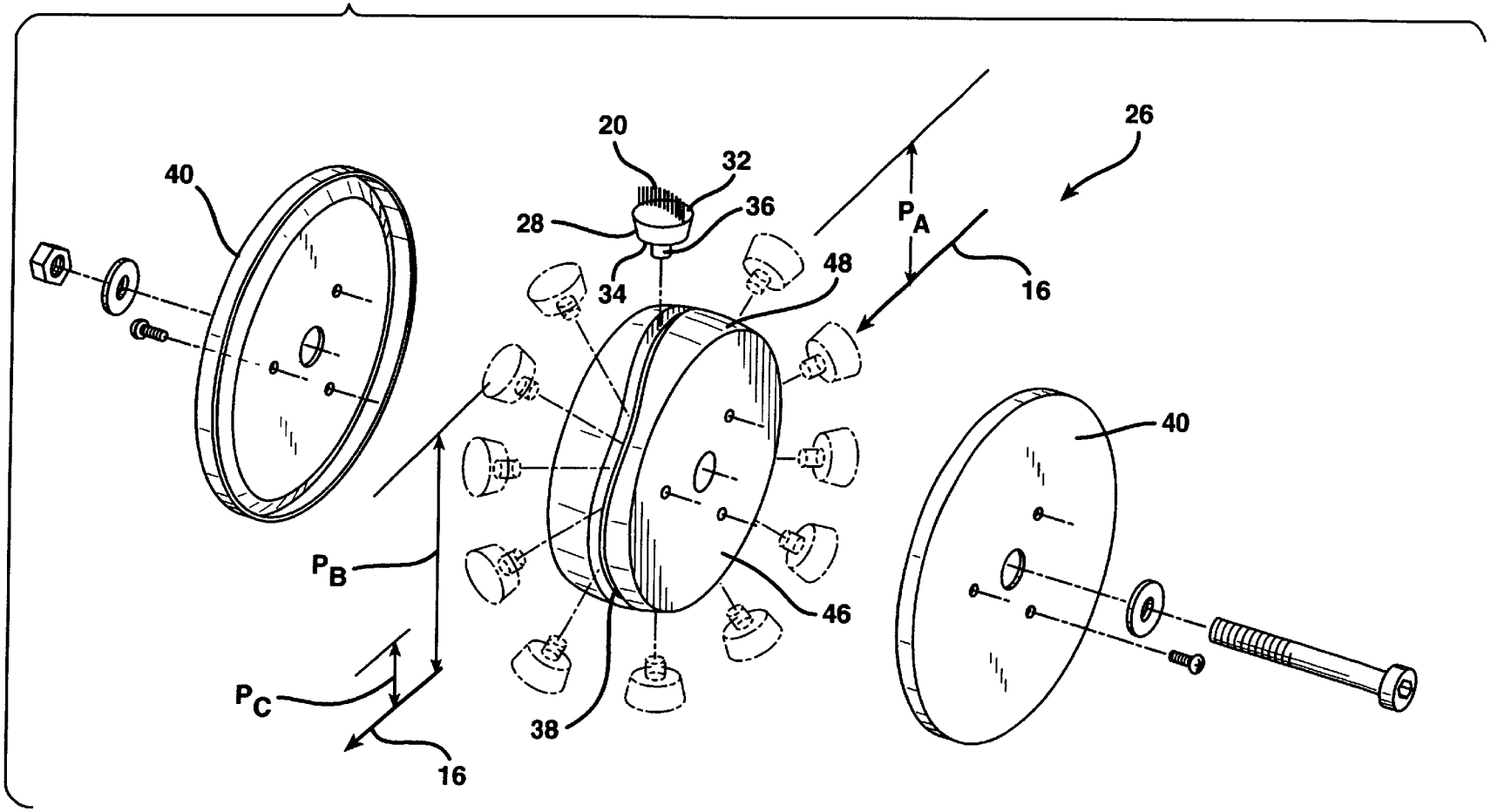
FIG. 5 is an expanded perspective view of a representative pin assembly of FIG. 1.
Figure 6:
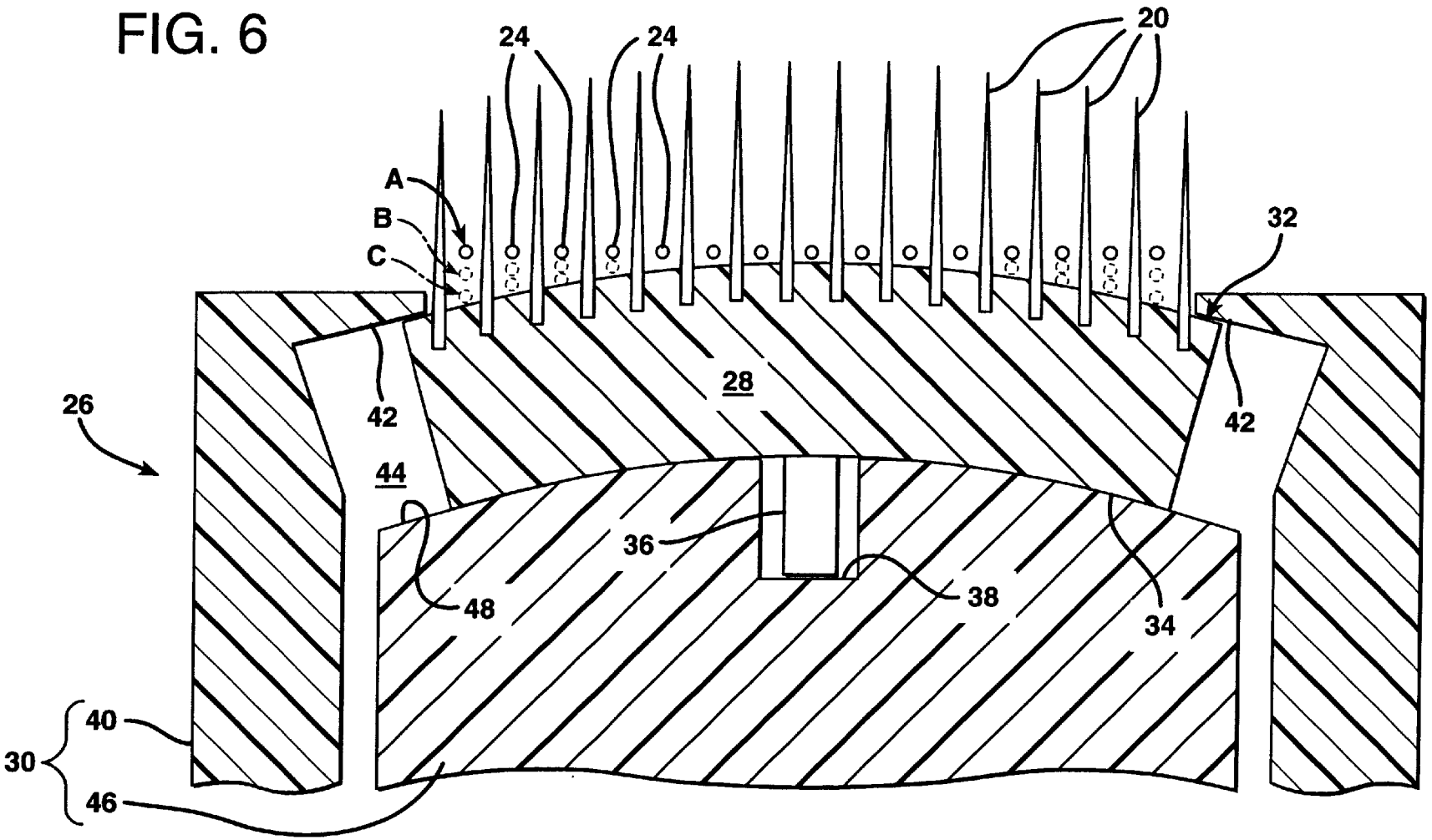
FIG. 6 is a partial cross sectional view of the pin support and pin assembly of FIG. 1.

The step of contacting the tow preferably includes varying the position, P, of the pins relative to the machine direction (see FIG. 5), and thereby penetrating the tow with a plurality of pins to divide the tow in bundles 24 (see FIG. 6). As shown in FIG. 5, the pins are moved in a circular motion to vary position P to contact and retract from the tow. The circular patterns shown could equally be an oval or other path which provides for contact and retraction of the pins for a period sufficient to allow for fiber spreading. Further movement of the pins in the machine direction along the tow path, in accordance with the preferred embodiment of FIG. 1, is caused by contact between the tow and pins which drives the pins along with the tow. The step of varying the spacing between pins is preferably accomplished by rotating at least one pin in contact with the tow relative to another pin in contact with the tow as the pins move, as shown best in FIG. 5. See also FIG. 2.

The term "fiber" is used herein to describe a single filament. The term "tow" is used herein to describe two or more fibers which are bonded or otherwise held together or collected together from conventional fiber production or collection processes. The fibers comprising the tow are preferably not twisted or wrapped about one another. The term "areal weight" or "areal density" is used herein to describe the weight/cross section area for a tow. Cross sectional area=height×width, where the area is generally transverse the length (the longest dimension of the tow). The machine direction 16 is defined as extending from the infeed to the outfeed of the fiber spreader long the centerline of the fiber spreader, as indicated in FIGS. 1–3, 10 and 11.

Referring again in greater detail to FIGS. 5 and 6, the pins are preferably organized into a pin assembly 26 in which at least one pin is located on each of a plurality of pin supports 28. Preferably the pin supports are generally circular and are disposed on a fixed base 30 such that they are movable along a predefined pin support path and are rotatable about an axis generally transverse to the pin support path while moving along the pin support path. The pin supports have top or first surfaces 32 from which the pins extend, and bottom or second surfaces 34 which are rotatable on the base. As shown in FIG. 6, the pins on the pin supports and the first surface of the pin support are preferably higher in the middle of the pin support, and lower towards the edges, and most preferably the length of the pins above the first surface of the pin support is uniform. Thus, both define a generally curved profile as seen in cross-section. As further shown in FIGS. 5 and 6, the periphery of the preferred pin support angled, and a cam follower 36 preferably shaped like a cylindrical pin extends from its second surface. In the preferred embodiment, the cam follower 36 is offset from the center axis of the pin support and permits rotation of the pin support. The base includes at least one cam track 38 which receives the cam follower 36 and defines the rotating motion of the pin supports as they move along the pin support path on the base.

Preferably, the curved profile of the pin support is optimized so that as the spacing between pins varies relative to the tow and the tow of fibers is spread into a plurality of bundles, each of the bundles follows a generally equidistant tow path through the pins. This reduces the stress on the fibers and fiber breakage which would otherwise occur on a flat surfaced pin support where the tow would be spread into a plurality of bundles having unequal path lengths. The stress on the fibers as well as differential longitudinal movement of the bundles can result in filament breakage. For example, the location of fibers is representatively shown in FIG. 6 at points A, B and C based on the pin rotation shown in FIG. 4. As can be seen, when the pins first contact and penetrate the tow, the path lengths are generally equal and parallel. As the pins are rotated to points B and C, the path lengths of the outward bundles successively lengthen. However, because the first surface of the pin support is curved, the stress is relieved, as shown in FIG. 6.

Figure 2:
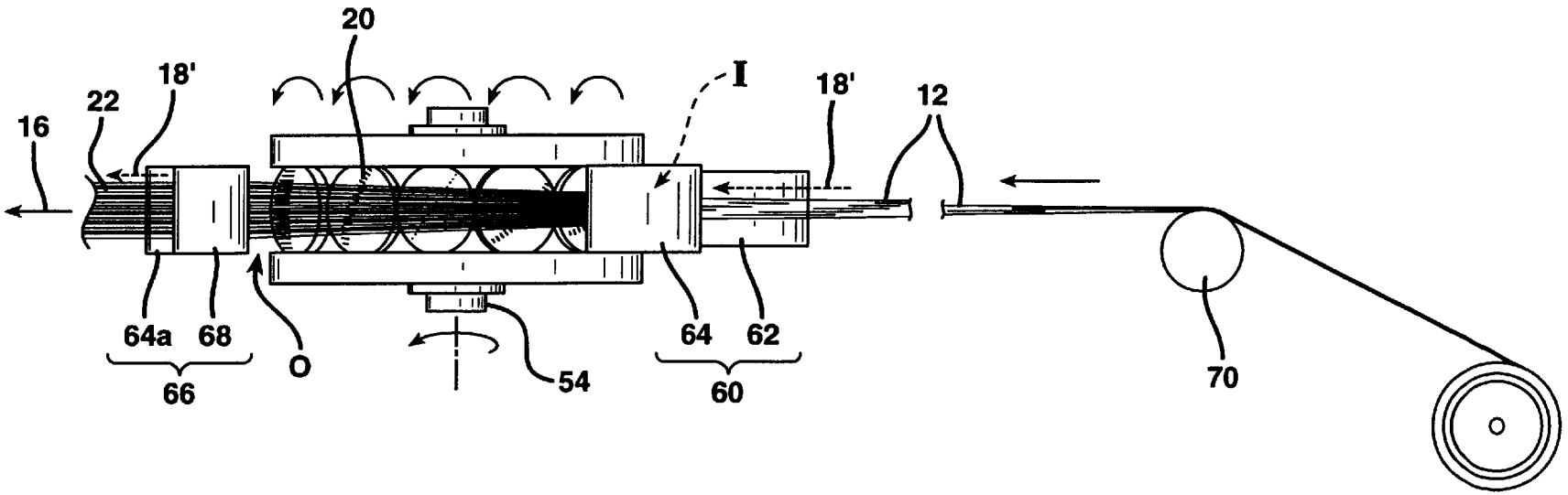
FIG. 2 is top plan view of FIG. 1.
Figure 3:
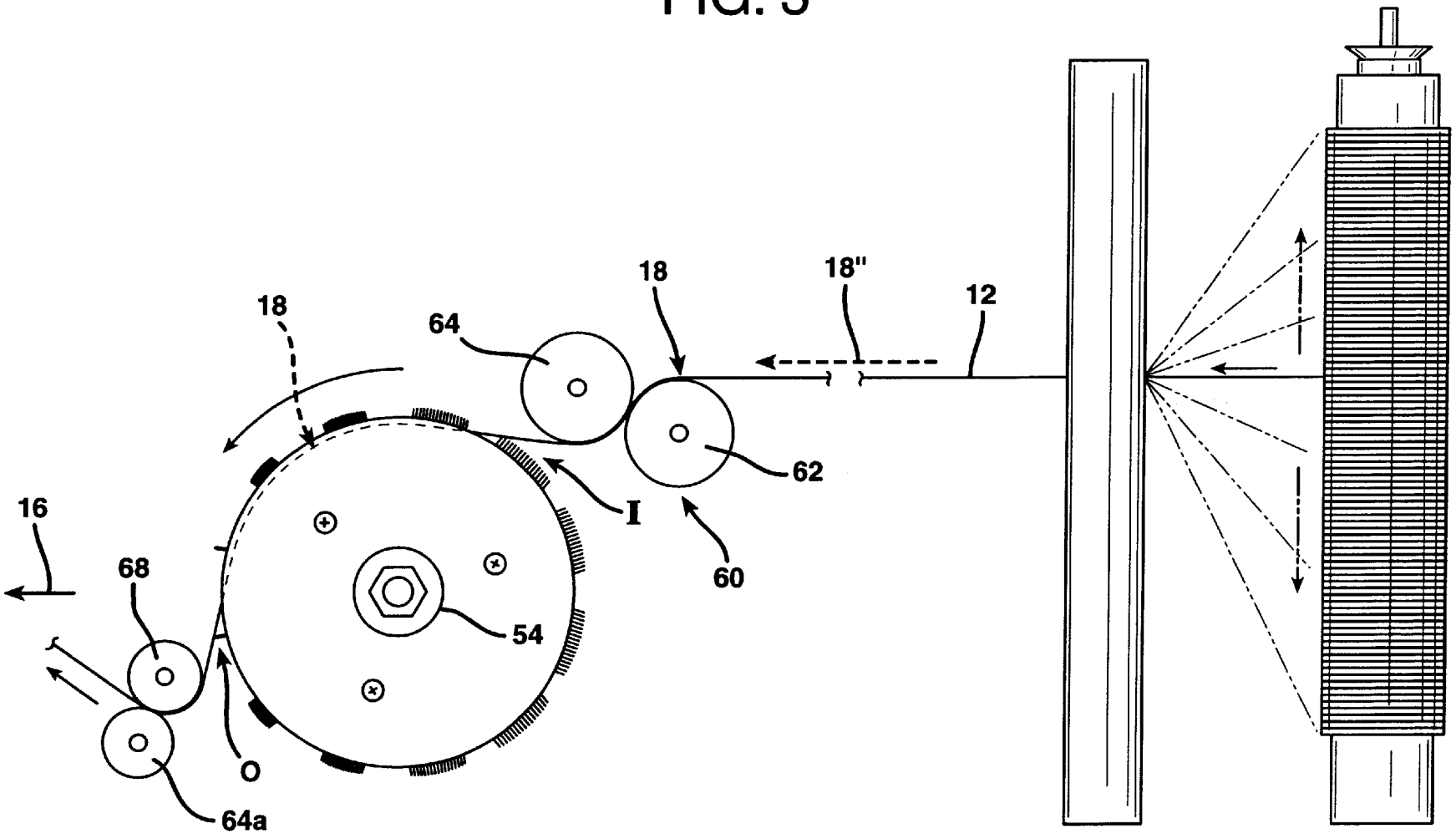
FIG. 3 is a side view of FIG. 1.
Figure 4:
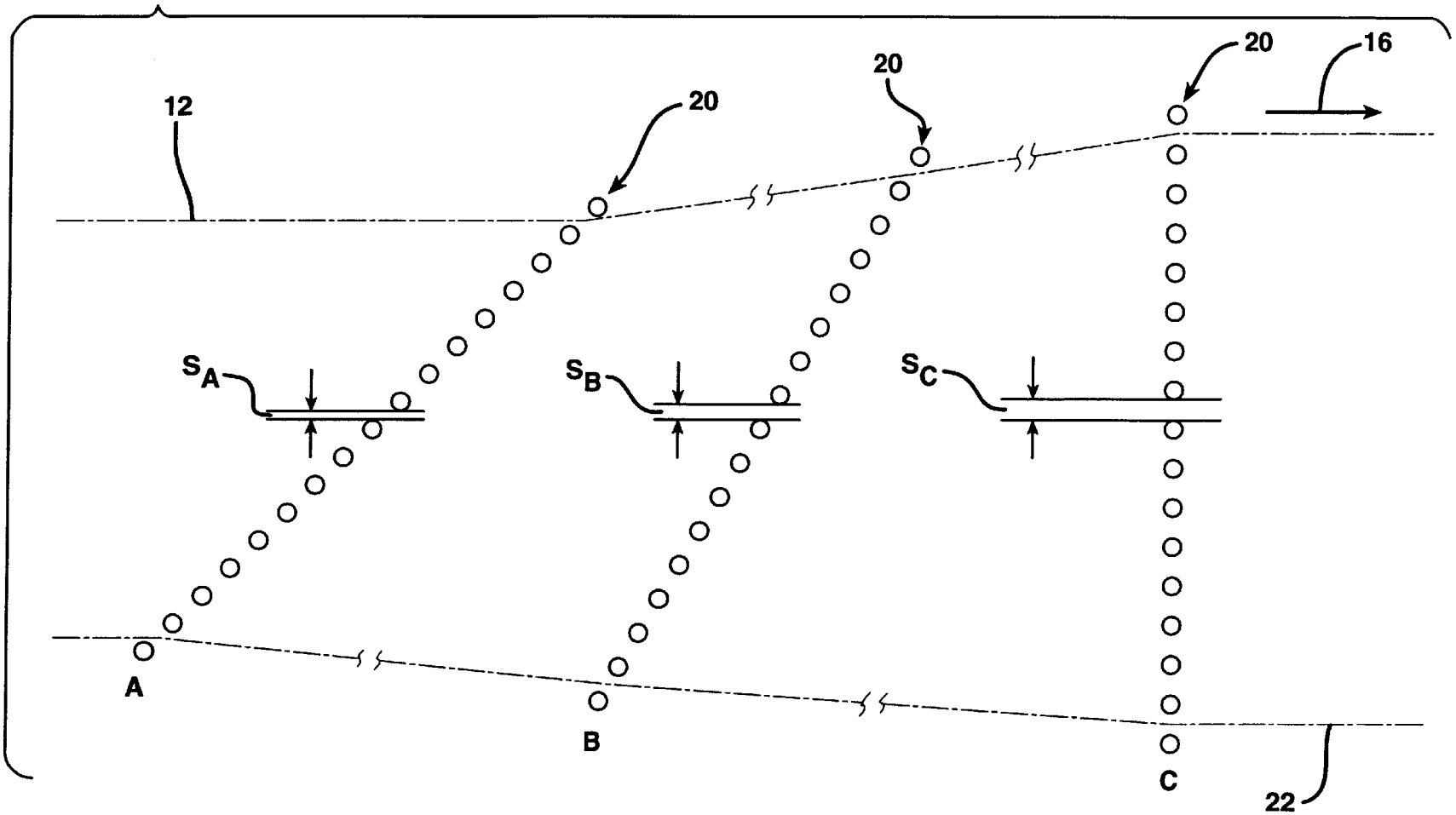
FIG. 4 is a schematic plan view of a tow and pins shown at different positions while spreading a tow.

As shown in FIGS. 1–5, consecutive portions of the tow are contacted with a continuous series of consecutive pin assemblies. Three are representatively shown in FIG. 4 for simplicity. In this regard, it is preferred that a plurality of pin assemblies be in contact with the tow during spreading. As best shown in FIG. 4, the pins are preferably aligned linearly across the first surface of the pin support. As further indicated in FIG. 4 at A, the location of the cam follower 36 on the pin support 28 and the cam track shape are designed such that the pins first contact the tow at I at an acute angle relate to the machine direction. The acute angle may be much more severe than shown in FIG. 4 and depends on the size of the tow relative to the pin support being used.

Figure 7A:
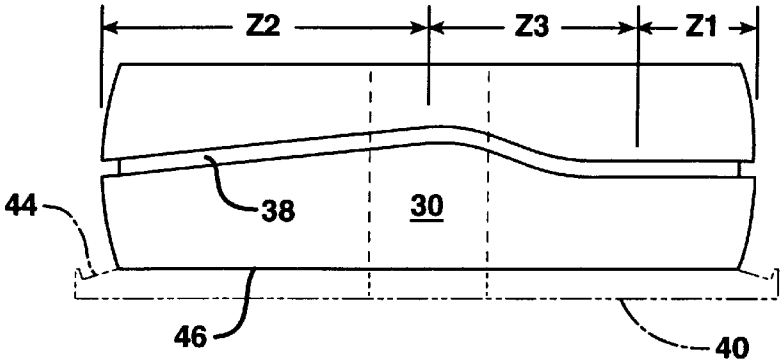
FIG. 7A is a side view of the central cylinder of FIG. 1 including a representative cam track.
Figure 7B:
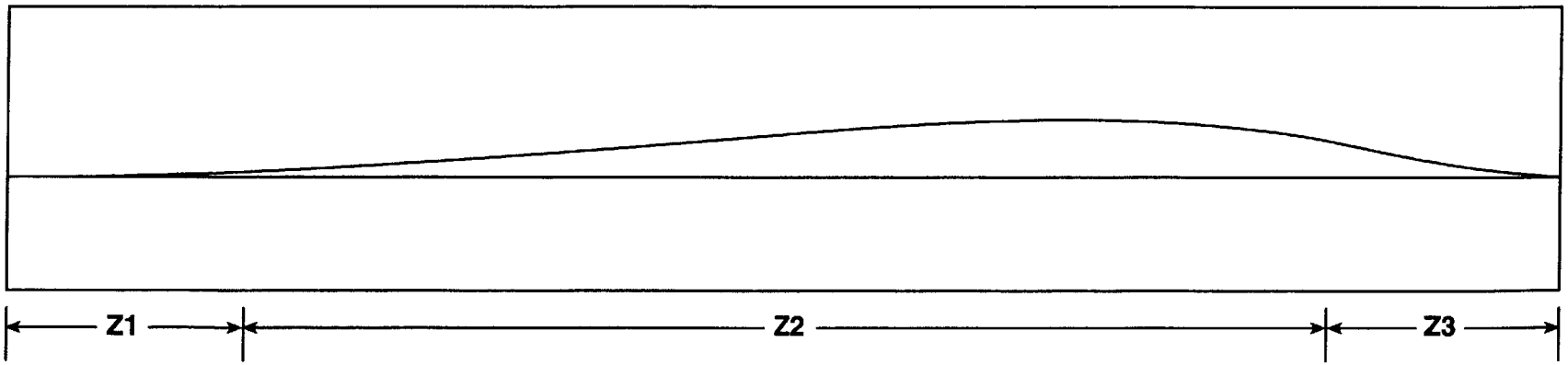
FIG. 7B is a flat projection of a representative cam track.

The cam track, representatively shown in FIGS. 7A and 7B, has several zones. In the first zone, Z1, the cam track is preferably linear to generally maintain the acute angle of the pins nearly constant or to spread the fibers only slightly from the point I of first contact until the pins of the next consecutive pin assembly contact the tow. This avoids unnecessarily stressing the fibers in the tow extending back to the infeed roller assembly 60. In the second zone, Z2, the cam track causes the pins to rotate to the extent desired for the particular application, typically to a 90 degree angle transverse to the machine direction. However, the rotation can go past 90 degrees relative to the machine direction. In practice, the pins may be rotated as afar as desired to achieve the width of spread fibers desired in the second tow. Again, it is desirable for a plurality of pin assemblies to be in contact with the tow to maintain it in a second spread condition prior to removal of the pins. The final zone, Z3, of the cam track is designed to quickly return the pin support to a starting position, after the pins retract from the tow at point O (see FIGS. 1 and 3). Thus, the cam track shown in FIGS. 7A and 7B is illustrative of the present invention, and may vary with the size of the fiber spreader, the size and type of the input tow, and the desired spread width in the second tow.

The base shown in FIGS. 1–6, 8 and 9 further includes two sides 40 having slightly inwardly angled opposing surfaces 42 which comprise a track 44 defining the pin support path along which the pin supports move and rotate (see FIG. 6), and a central cylinder 46 having rounded exterior surfaces 48 which define the bottom of the track. The angle of the opposing surfaces 42 is such that the track retains the pin supports, and may vary depending on the size of the apparatus. In operation, the central cylinder and sides are locked in place on axle 54, and the pin supports are driven freely around the track by contact with the tow, rotating as dictated by the cam track. As shown in FIGS. 7A and 7B, the distance between the cam track 38 and each of the opposing surfaces 44 varies along the length of the cam track. Each pin support is caused to rotate as its cam follower 36 moves through a changing section of the cam track, i.e., where the distance between the cam track and each of the opposing surfaces 44 is changing. The angle at which the pins first contact the tow can be varied by adjusting the position of the base on axle 54. In an alternative configuration (not shown) the sides of the base may have ribs or grooves into which corresponding grooves or ribs in the pin support may be slidably disposed to maintain the pin supports in the track. However, this alternative configuration has a greater propensity to bind up as the pin supports rotate and travel along the curved track and are not preferred.

Alternatively, the pin alignment may be non-linear (not shown) or the pin spacing across the first surface non-uniform (not shown) to provide more pins to a portion of a given input tow to provide greater or lesser spreading of a portion of the tow. It is also understood that the present invention may be used to pull together one or more tows to align the fibers into one or more narrower tows.

Figure 13:
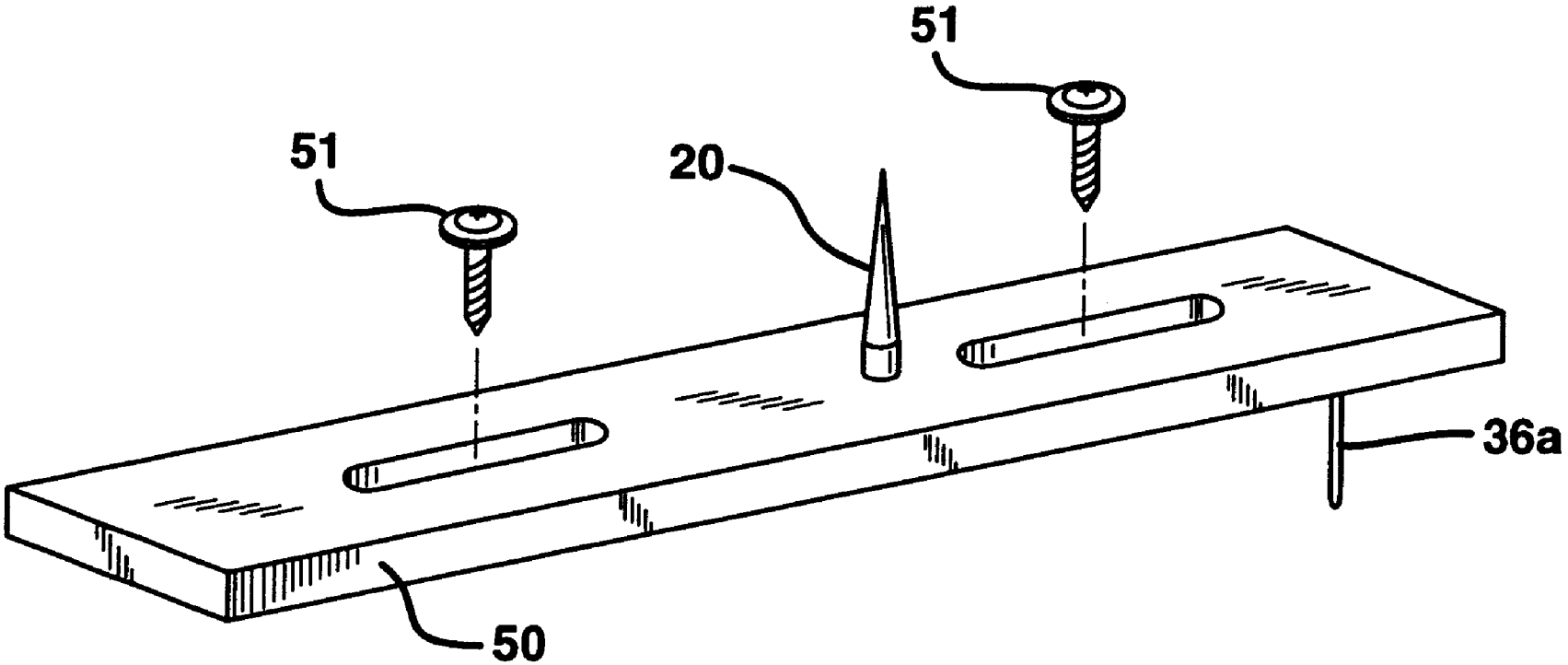
FIG. 13 is perspective view of a representative pin support of the alternative embodiment of FIG. 10.

The pins are preferably tapered over a substantial portion of their length, for example as shown in FIG. 13. The taper preferably extends three-quarters of the exposed length of the needle, and facilitates smooth release of the bundles of fibers at point O which form the spread, second tow. The diameter of the pins may vary with the desired spread width, areal density, and the fiber dimensions and type.

The pin supports and elements of the base in contact therewith are preferably made of a material of have a coating which permits parts to slide over each other and avoid sticking. In the preferred embodiment, the pin supports, cam follower sides, central cylinder and cam track are preferably made of Delrin®, generally commercially available, and made by E.I. DuPont de Nemours & Co., Wilmington, Del.; and the pins are preferably made of stainless steel or brass.

Figure 10:
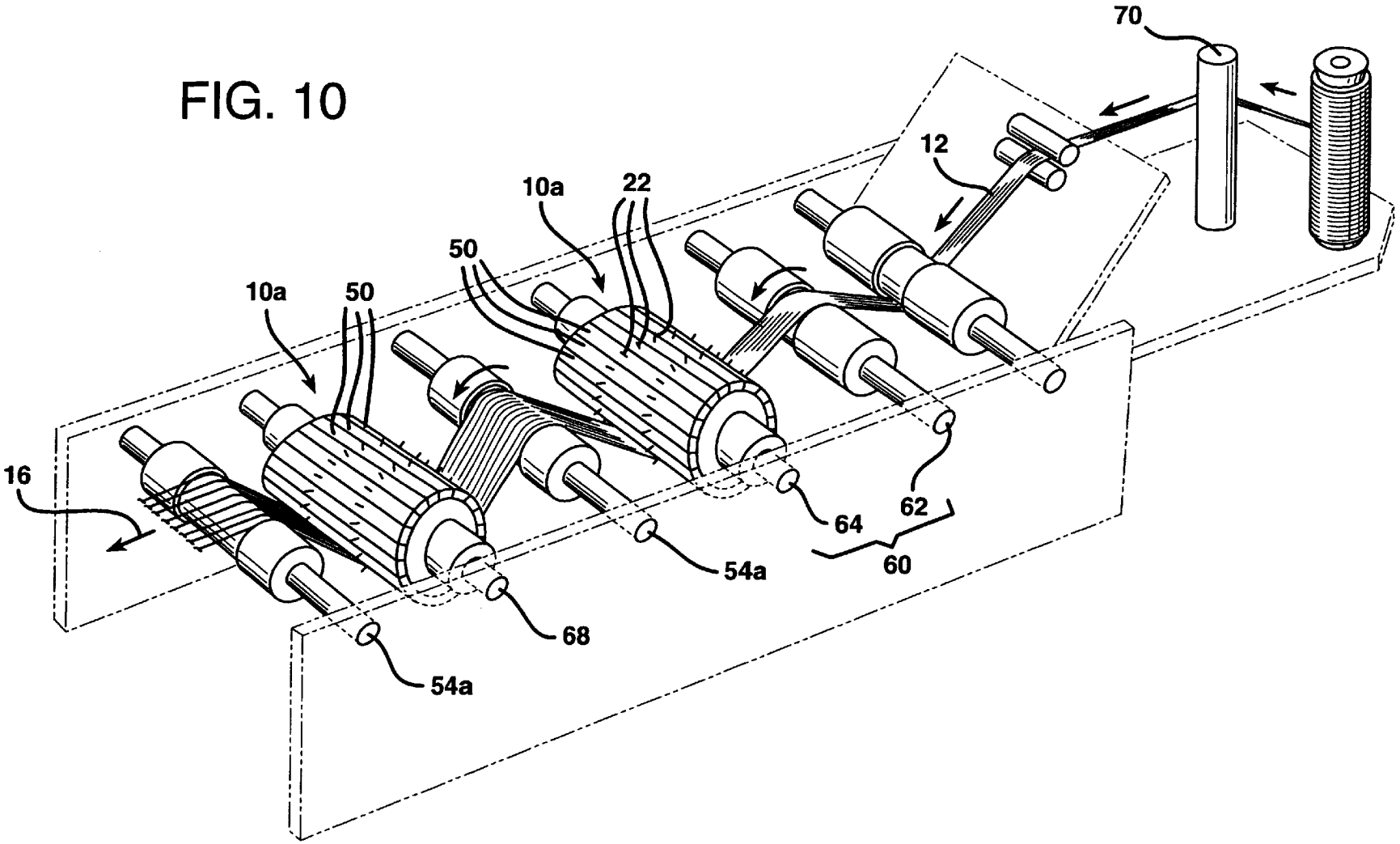
FIG. 10 is a schematic perspective view of an alternative two stage embodiment of the present invention.
Figure 11:
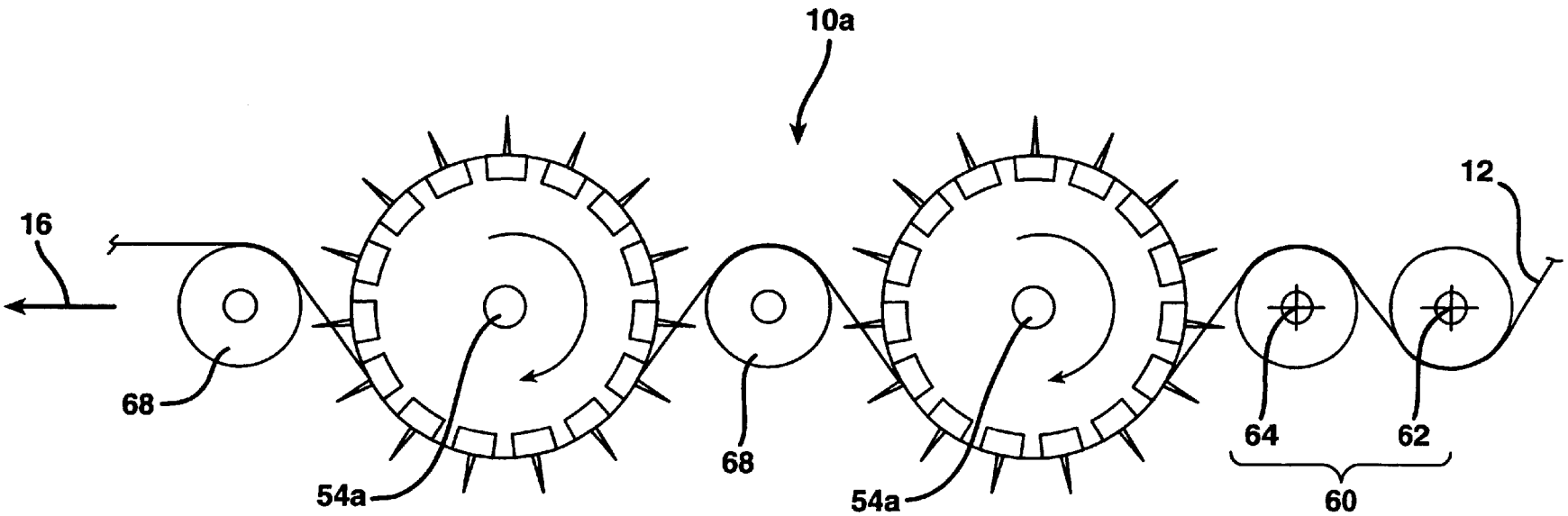
FIG. 11 is a side view of FIG. 10.

In the alternative embodiments of the spreader apparatus 10*a* shown in FIGS. 10–17, where like elements have like numerals, the step of varying spacing between pins may be accomplished by moving at least one pin transversely to the machine direction relative to another pin. As well, FIGS. 10 and 11 show a two stage fiber spreader 10*a*, where the spread second tow from the first stage fiber spreader becomes the input tow for the down stream, second stage fiber spreader.

Figure 12:
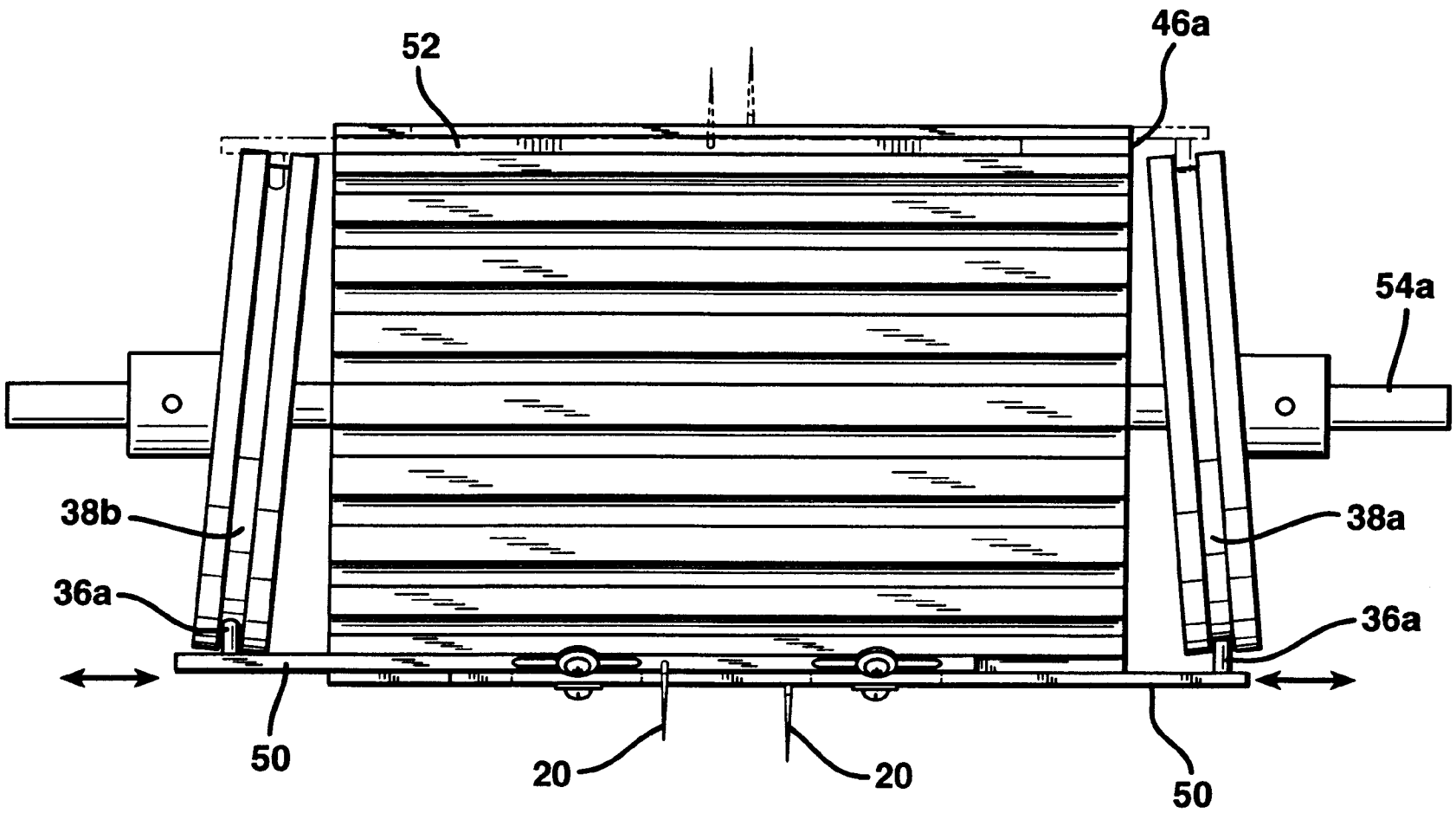
FIG. 12 is a partial view of the pin assembly of FIG. 10 with slats removed to show detail.

In accordance with the alternative embodiments of FIGS. 10–15, the pins are disposed on pin supports which comprise slats 50 (best shown in FIG. 13), and the base comprises a central cylinder 46*a* (see FIG. 12) having grooves 52 in which the slats slide laterally in directions generally parallel to the axis of rotation of the central cylinder 46*a* around axle 54*a*. A cam follower 36*a* at end portions of each slat follows a respective cam track, either cam track 38*a* and 38*b*, which are disposed at opposite ends of the base on end portions of axle 54*a* to drive the opposing motion of the slats. Preferably, adjacent slats are driven in opposite directions. The central cylinder is freely rotatable on the axle 54*a*, while the cam tracks 38*a* and 38*b* are generally fixed on the axle. Cam tracks 38*a* and 38*b* may be generally linear as shown in FIG. 12 or curved as representatively shown in FIGS. 7A and 7B. The axle is locked in place during operation. The starting spacing between the pins on consecutive slats can be varied by unlocking and rotating the axle to adjust the position of the cam follower.

Figure 14:
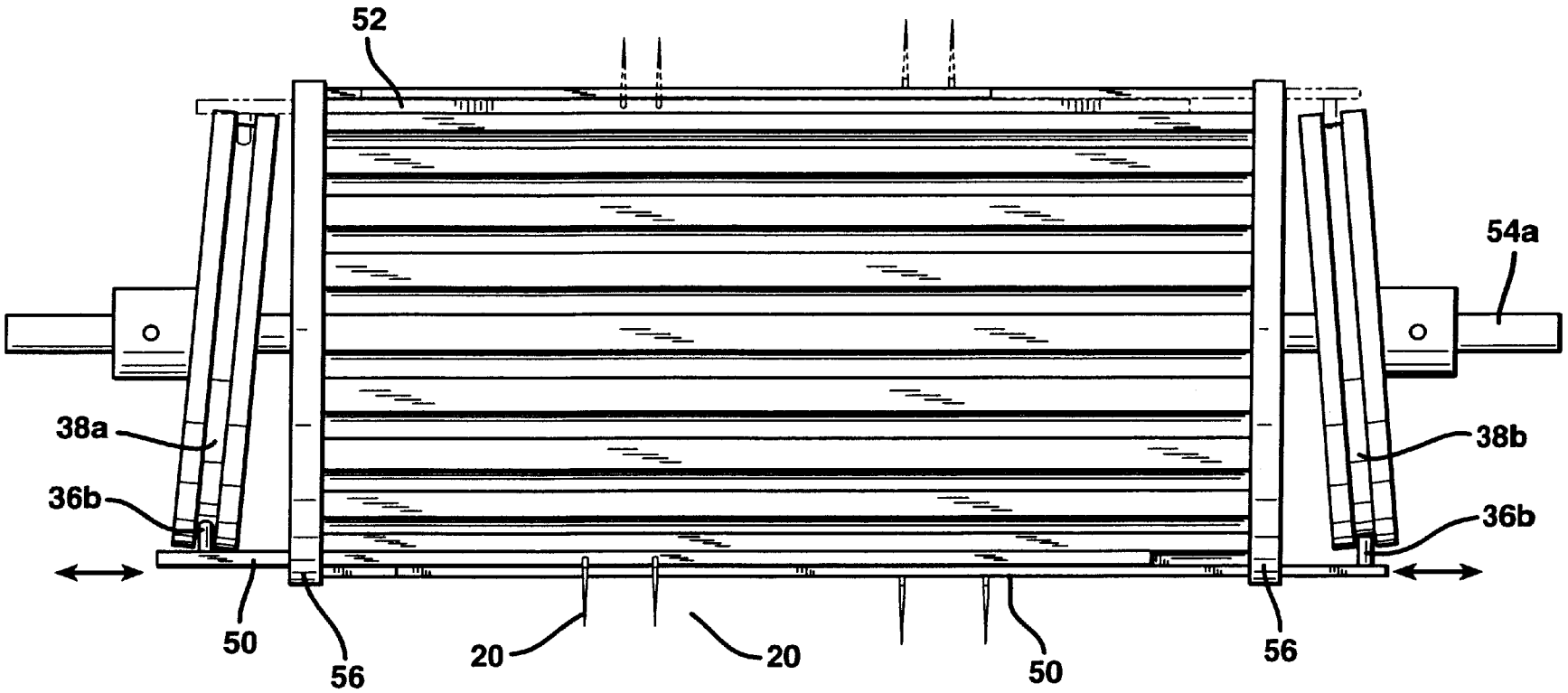
FIG. 14 is a partial view of an alternate pin assembly for the alternate embodiment of FIG. 10 with slats removed to show detail.
Figure 15:
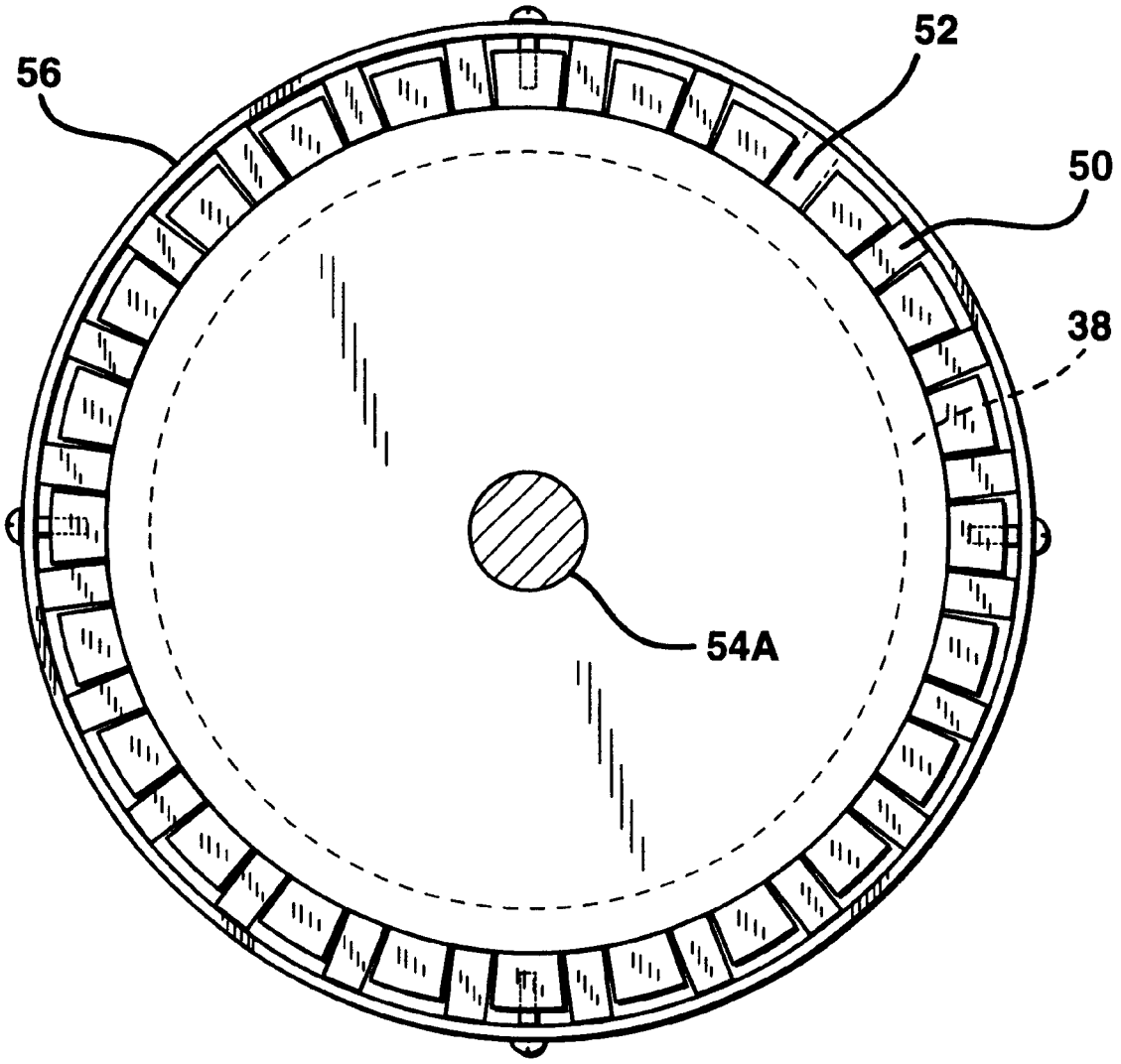
FIG. 15 is an end view of the base of FIG. 14.

Accordingly, in the alternative embodiment of FIGS. 10–17, the step of contacting the tow with the pins rotates the pin assembly. Motion of the central cylinder on the axle causes the pin supports to follow the cam tracks and move transversely to the machine direction. Alternate ones of the pin assemblies move in generally opposite directions while contacting consecutive portions of the tow. FIGS. 10–13 show a first configuration for the pin assembly, using slotted slats slidably held in place by bolts 51. FIGS. 14 and 15 show a second configuration for the pin assembly using slats held in place by retainer rings 56. It is understood that in either configuration, the single pin show may be a plurality of pins, and that the travel of the pins is not intended to overlap when viewed in the machine direction.

Figure 16:
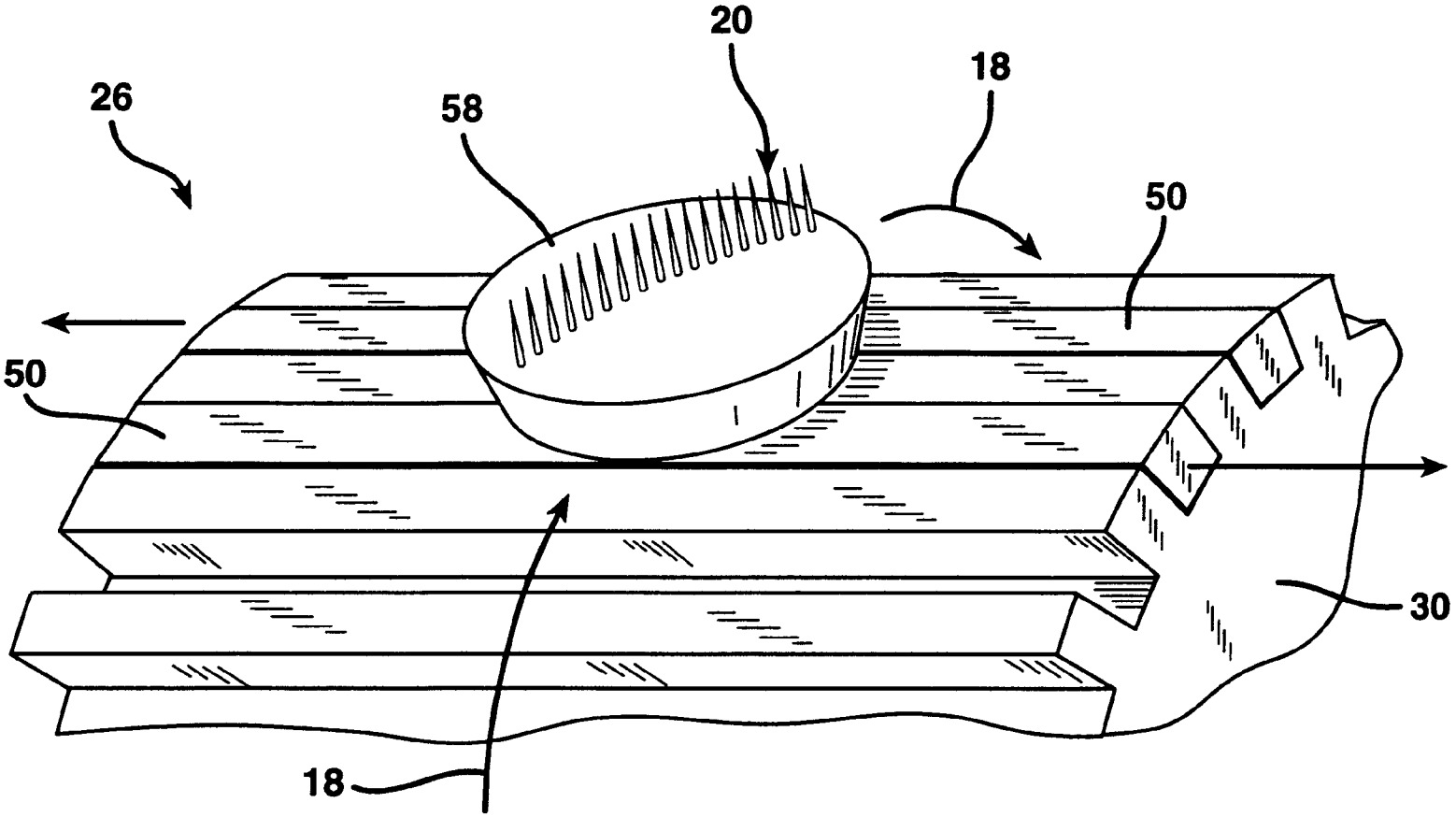
FIGS. 16 and 17 are detail views of a second alternative pin support in first and second positions for the alternative embodiment of FIGS. 10 and 14.
Figure 17:
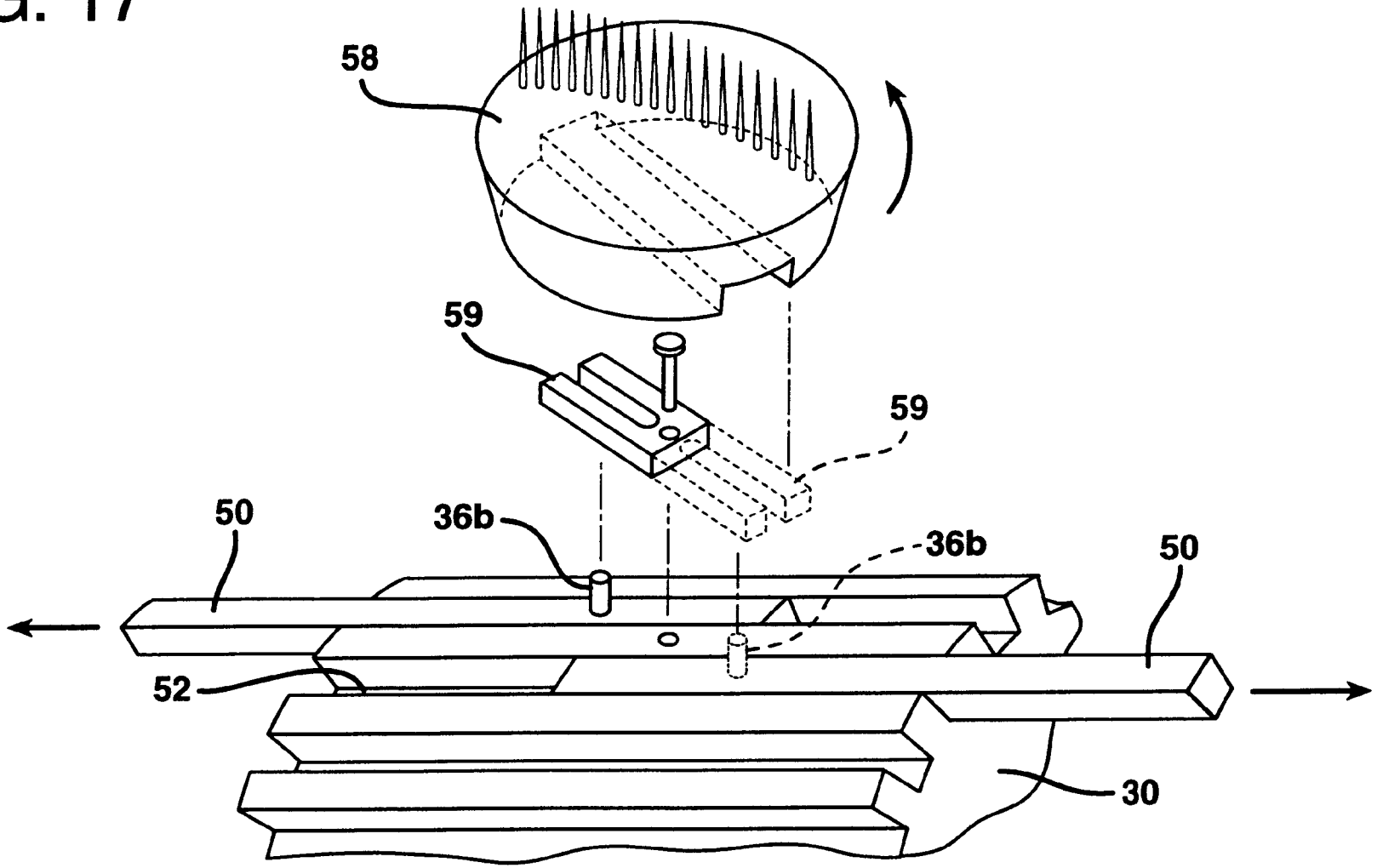

In the further alternative embodiment of FIGS. 16 and 17, the pins present in FIGS. 10–15 are replaced by a plurality of pins disposed on second pin supports 58 rotatably mounted on pairs of slats which move in alternate directions as aforesaid. The second pin supports are substantially the same as pin supports 28 described above with regard to the preferred embodiment, except that the second surface includes other elements to connect to the slats and provide for rotation of the second pin supports 58. The configuration shown in FIGS. 16 and 17 is illustrative of the many mechanical means by which such connection and rotation may be accomplished. As shown in FIG. 17, the second surface of second pin support 58 includes a channel into which is nested the slotted bar 59. Slotted bar 59 is rotatably connected to the central cylinder 46*a* between pairs of slats 50. The slot of the slotted bar slides over cam follower 36*b* which extends upward from an adjacent slat. As the slat moves transversely in it rotates the second pin support 58. This configuration is preferred as it minimizes the opportunity for the moving parts to bind up in operation, however an alternative configuration using an elongated slotted bar with two slots, a pair of cam followers, and a pair slats is shown in dashed lines.

In a further aspect of the present invention, the process of spreading a tow of fibers may further include moving a plurality of input tows of fibers along a series of separate tow paths, and the steps of contacting, varying pin spacing and spreading the tow, and then retracting the pins are performed along the separate tow paths on the input tows moving along each tow path. In this regard, additional tow paths 18' and 18" are illustratively indicated in FIGS. 2 and 3 to show adjacent or stacked input tows positioned thereon. It is understood that a sufficiently large pin support 28 or 58 could contact and spread a plurality of tows positioned thereon. It is further understood that separate sets of pins or second pin supports in the alternate configurations of FIGS. 10–17 could be provided to spread separate tows.

In a still further aspect of the present invention, the process of spreading a tow may further include one or more roller assemblies to maintain alignment of the input tow and spread of the second tow. Preferably the input tow is aligned with at least one infeed roller assembly 60 having a rotatable alignment roller 62, as shown in FIGS. 1–9. Alignment roller 62 in the preferred embodiment of FIGS. 1–9 has a saddle shaped depression, but may vary in shape as necessary to produce its alignment function for a given input tow. In this regard, the alignment roller in the alternative embodiment of FIGS. 10–17, has a notch with tapered sides to position the tow in the tow path prior to contacting the tow with the pins.

In the preferred embodiment an additional idle roller 64 helps maintain alignment and positions the input tow for contact with pins at I. It is understood that alignment roller 62 could be used alone to position a tow for contact with the pins by directing the tow around the underside of alignment roller 62. However, the arrangement shown in FIGS. 1–3 is preferred. Where the input tow is unwound from a stationary bobbin, it is further preferred to provide other elements, such as grooved post 70, to prevent excessive wander of the input tow and maintain a consistent alignment of the input tow. Grooved post 70 preferably has grooves of approximate 0.005 inches in depth. Still further, the process of spreading a tow may further include maintaining the second, spread tow 22 in a spread condition removing the pins with at least one outfeed roller assembly 66 having a rotatable grooved roller 68 contacting the spread tow. In connection with the outfeed rollers, it is preferred, as shown in FIG. 1 to include additional idle roller 64*a*.

Figure 8:
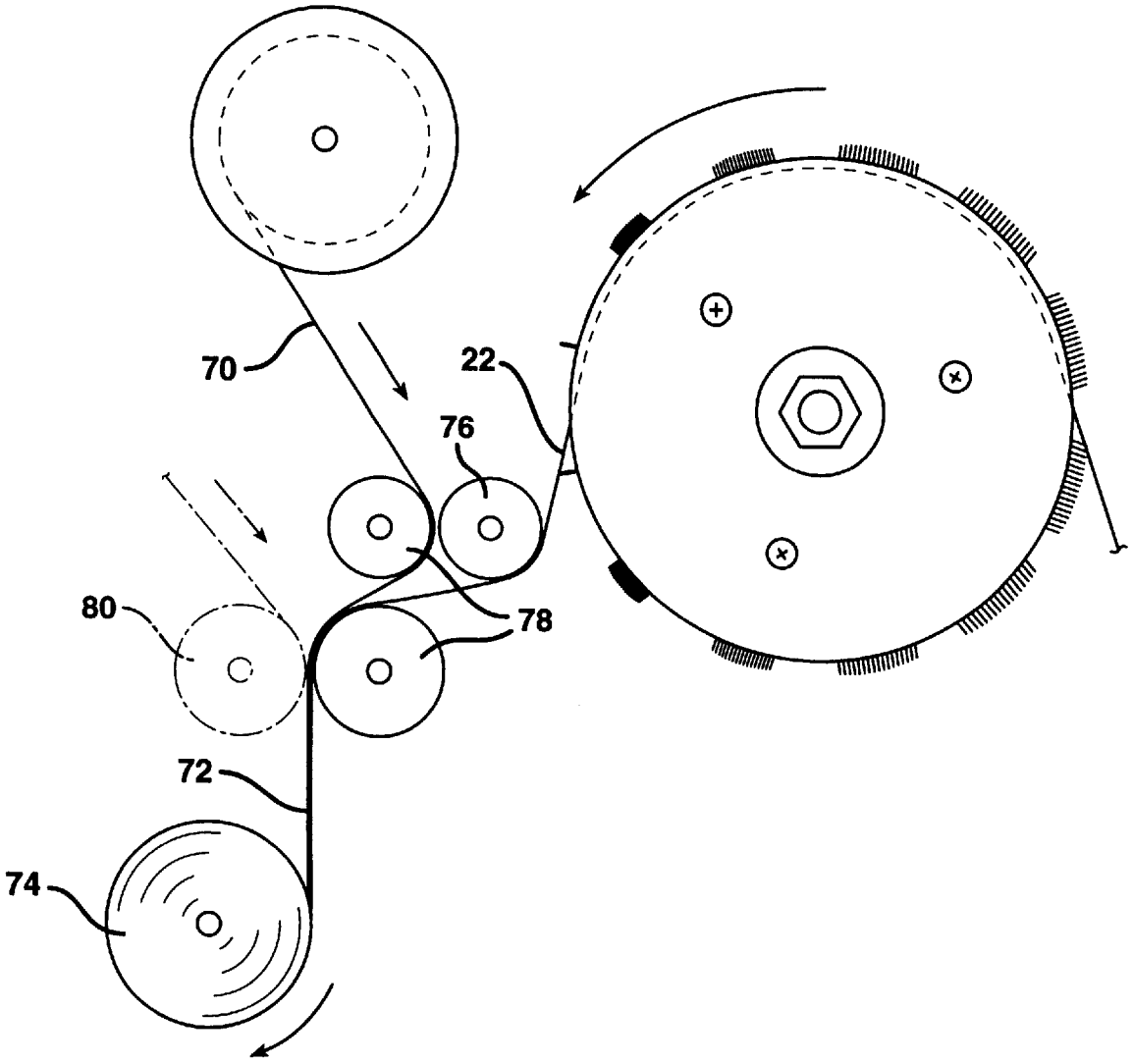
FIG. 8 is a side view of a representative downstream collection apparatus for FIG. 1 or FIG. 9.
Figure 9:
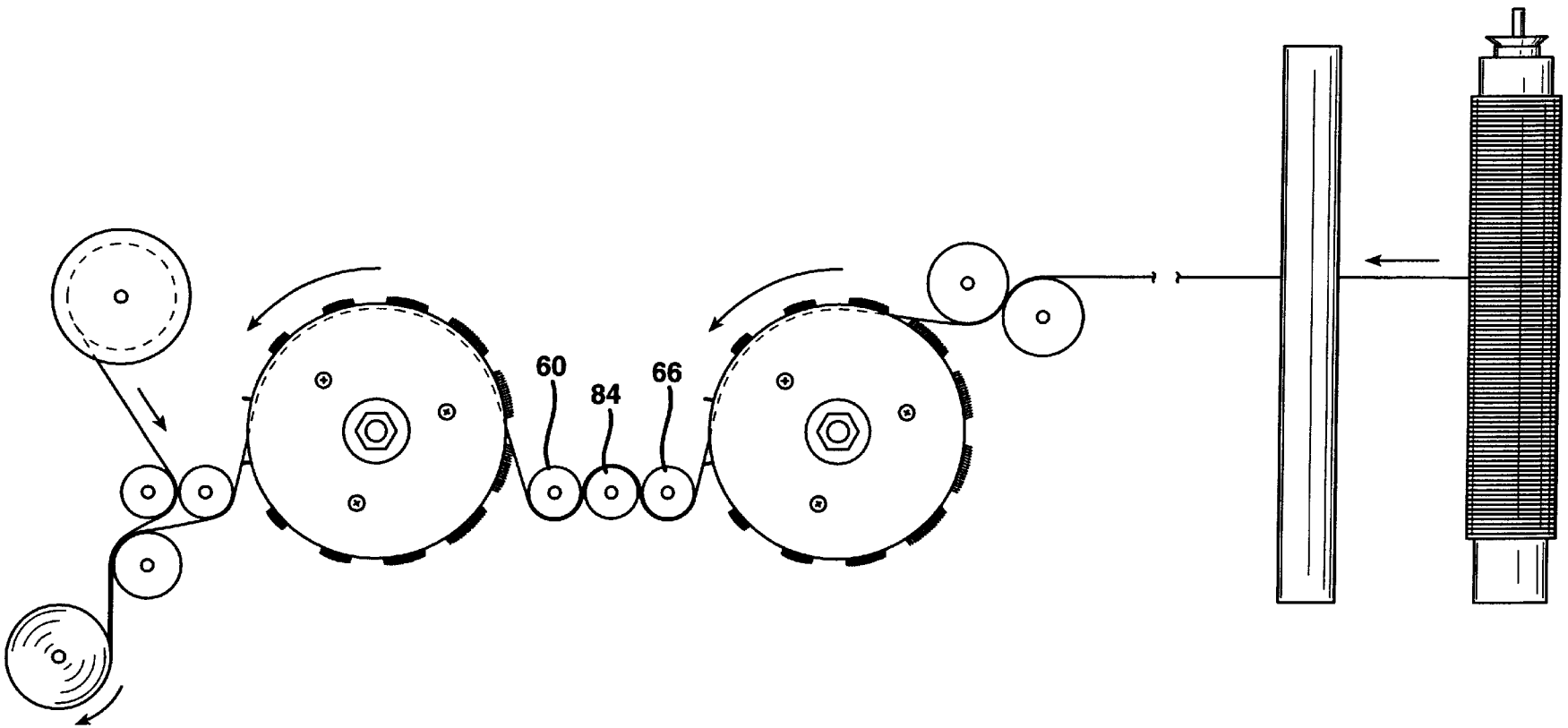
FIG. 9 is a schematic perspective view of a two stage configuration of the preferred embodiment of FIG. 1.

In yet another aspect of the present invention shown in FIGS. 8 and 9, the process of spreading a tow may further include maintaining the second tow in a spread condition after retracting the pins by providing a web 70 comprising an adhesively coated substrate to which the second tow 22 is adhered to produce a spread fiber product 72. Alternatively, a polymeric film or web (not shown) formed from a thermoplastic material such as polyamide, polypropylene, polyester, polyethylene, polyphenylene sulfide or a like material may be used in place of the adhesively coated substrate. The thermoplastic fabric or web is heated, joined to the spread tow and cooled such that it bonds or fuses to the tow. The film or web may also comprise a layer of thermosetting material which is either partially or fully cured after being combined with the tow. It is further contemplated that the spread tow may be subjected to an in-line or off-line impregnating, coating, pultruding or like process where the spread tow is treated with a polymer or other material or resin systems, including but not limited to thermoset or thermoplastic polymers, and known materials to prepare fibers for use in composite materials. Thus, for example, the web 70, which is adhesively joined to the tow in the illustrated embodiment, may be used to maintain the tow in spread condition and stored on a take up reel 74 for later off line processes. The web 70 may be removable or intended to be permanent, be a carrier for other materials or may be made of a resin or other material which carries the spread tow into a product application. The embodiment illustrates application of an adhesive web to the second tow. Preferably, the roller 76 is a fixed roller, while rollers 78 are rotatable. Other rollers 80 (indicated generically in phantom), such as heated rollers, pressure rollers or applicator rollers can be used to apply heat, pressure or chemicals to the spread, second tow.

In still another aspect of the present invention shown in FIG. 9, the fiber spreading process of the present invention may be repeated with a second fiber spreader. As shown, the steps of moving the tow, contacting the tow with pins, varying the spacing of the pins, spreading the fibers, and retracting the pins are performed on the second tow. While two spreaders are shown in FIG. 9, it is understood that more than two stages of fiber spreading are possible depending on the ultimate width of the spread desired from an input tow. It is understood that the size of the fiber spreaders and the spread widths may vary in each stage of fiber spreading. As shown, a transition die 84 is added between the outfeed roller 66 and the second stage infeed roller 60. The transition die preferably does not rotate and includes a groove of predetermined width to provide a second tow 22 of predetermined width and alignment as input to the second fiber spreader 10.

In a still further embodiment, the present invention includes a fabric comprising a plurality of fibers including at least one spread, second fiber tow. In this regard, the second fiber tow may be produced in-line or off-line, as described above. The fabric may be woven, non-woven, and the fibers may be further stitched, bonded, coated, heated or otherwise connected to form the fabric. The fabric may consist of fibers of different types, and preferably the plurality of fibers in the fabric include at least one fiber tow. It is further contemplated that the fabric may include a plurality of layers interconnected to form a honeycomb material, and that at least one of the layers includes at least one spread second tow. It is understood that a single transition die 84 could be used between the stages, however, the embodiment shown is for greater control of alignment.

The types of input tows which can be used in accordance with the present invention can vary widely. It is understood that there is no minimum and maximum tow size. However, the tow denier is preferably from 50 to 200,000. A list of fibers which may potentially find use in the fiber spreader of the present invention to spread tows is set forth in PCT Application No. WO92/08095, published May 14, 1992, the relevant disclosure of which is incorporated herein by reference. However, by way of example and not limitation, the preferred fibers of the present invention are continuous reinforcing fibers such as glass fibers (including but not limited to S-glass or E-glass), rockwool fibers, natural fibers (e.g., cotton fibers) or other synthetic fibers. The other synthetic fibers may comprise fibers formed from materials such as aramid, carbon or graphite, a metallic or ceramic material, a polymeric material such as polyester, and other non-glass man-made materials having suitable reinforcing characteristics. It is also contemplated that the fibers may comprise non-reinforcing fibers formed, for example, from a polymeric material such as polyamide, polypropylene, polyethylene, and polyphenylene sulfide. The fibers may also comprise fibers formed from any other fiberizable polymer material.

Having described the invention in detail and by reference to preferred embodiments thereof, it will be apparent that modifications and variations are possible without departing from the scope of the invention defined in the appended claims.

What is claimed is:

1. A fiber spreader for spreading a tow of fibers moving in a machine direction, comprising:

a plurality of spaced pins wherein the spacing between said pins is variable relative to the machine direction, the position of said pins is variable relative to the machine direction, and said spacing and said position are variable during motion of said pins in the machine direction, wherein at least two pins are located on a pin support, a path of travel of the tow of fibers extends throughout the machine and is defined in the machine direction, and said pin support rotates about an axis that passes through said path.

2. A fiber spreader for spreading a tow of fibers moving in a machine direction comprising:

a plurality of spaced pins wherein the spacing between said pins is variable relative to the machine direction, the position of said pins is variable relative to the machine direction, and said spacing and said position are variable during motion of said pins in the machine direction, wherein at least one of said pins is rotatable relative to another pin, and the spacing between said pins relative to the machine direction is variable by rotation of at least one pin relative to another.

3. The fiber spreader of claim 1 wherein said pins are moved when at least two pins contact a tow moving along said path in the machine direction.

4. The fiber spreader of claim 1 wherein the spacing between said spaced pins relative to the machine direction is adjustable at the point where said pins first intersect said path.

5. The fiber spreader of claim 1 wherein said pins are tapered to facilitate contact, spread and release of fibers in a tow moving along said path in the machine direction.

6. The fiber spreader of claim 1 wherein said pins are organized into a pin assembly in which at least two pins are located on each of a plurality of pin supports, said pin supports are moveably disposed on a base, and wherein each of said pin supports is rotatable about an axis transverse to and passing through a center axis of said base.

7. The fiber spreader of claim 6 wherein said pin supports have first and second surfaces and said first surfaces includes a plurality of pins and said second surface is rotatable on said base.

8. The fiber spreader of claim 7 wherein, on one of said pin supports, the pins are aligned linearly and the spacing between the pins relative to the machine direction on one of said pin supports is variable by rotation of the pin support.

9. The fiber spreader of claim 8 wherein, said first pin support surface comprises a middle portion, the aligned pins being higher at the middle portion of the pin support and lower distal from said middle portion.

10. The fiber spreader of claim 7 wherein the pin support comprises a curved first surface defining between said pins a plurality of generally equidistant paths when said pin support is rotated to generally maximize the spacing between said pins.

11. The fiber spreader of claim 6 wherein said pin supports have first and second surfaces and said pin supports include a cam follower extending from said second surface and said base includes at least one cam track defining the motion of said pin supports on said base.

12. The fiber spreader of claim 11 wherein said base comprises a fixed wheel having a circumferential surface and a circumferential groove provided in said circumferential surface, the circumferential groove includes said cam track, and said pin support is a rotatable disc disposed in said circumferential groove having said cam follower eccentrically located on said second surface.

13. A fiber spreader for spreading a tow of fibers moving in a machine direction, comprising:

a plurality of spaced pins wherein the spacing between said pins is variable relative to the machine direction, the position of said pins is variable relative to the machine direction, and said spacing and said position are variable during motion of said pins in the machine direction, wherein said pins are organized into a pin assembly in which at least one pin is located on each of a plurality of pin supports, said pin supports being moveably disposed on a base, said pin supports have first and second surfaces and said pin supports include a cam follower extending from said second surface, said base includes at least one cam track defining the motion of said supports on said base, said base comprises:

an axially rotatable central cylinder having an outer surface including a plurality of grooves therein generally parallel to the axis of rotation of said cylinder, said cylinder being freely rotatable; and axially rotatable cam tracks located at opposing ends of said cylinder having a common axis of rotation with said cylinder and being rotatable together relative to said central cylinder; and said pin supports comprise:

slats, ones of said slats disposed in ones of said grooves, and said slats having end portions one of which includes said cam follower extending into one of said cam tracks so as to follow said one of said cam tracks to effect movement of a corresponding one of said slats along an axis generally parallel to the axis of rotation of said cylinder and a central portion including at least one pin.

14. A fiber spreader for spreading a tow of fibers moving in a machine direction, comprising:

a plurality of spaced pins wherein the spacing between said pins is variable relative to the machine direction, the position of said pins is variable relative to the machine direction, and said spacing and said position are variable during motion of said pins in the machine direction, wherein said pins are organized into a pin assembly in which at least one pin is located on each of a plurality of slats, said slats being disposed on a base so as to move linearly relative to said base, each of said slats has at least one pin on a first face and said slats are moveable transversely on said base relative to said machine direction and alternate ones of said slats move transversely in opposite directions from the adjacent slats.

15. The fiber spreader of claim 1 further comprising at least one infeed roller and at least one outfeed roller, said infeed roller having a notched portion defining a portion of said path, and said outfeed roller having a grooved portion defining a portion of said path.

16. The fiber spreader of claim 1 further comprising a grooved infeed post defining a portion of said path.

17. The fiber spreader of claim 3 further comprising a tape dispensing device positioned to place one surface of a tape in contact with a tow after at least two pins contact the tow, whereby fiber spread by said pins may be maintained in a spread condition.

18. The fiber spreader of claim 6 including at least two pin assemblies in series.

19. The fiber spreader of claim 1 wherein a plurality of paths are defined therethrough in the machine direction.

20. A fiber spreader for spreading a tow of fibers and having a path of travel for the tow of fibers which extends throughout the machine, said path being defined in a machine direction, and comprising a plurality of spaced pins positionable to vary the spacing between said pins relative to said machine direction during contact between said pins and the tow moving along said path, wherein at least two pins are located on a pin support and said pin support rotates about an axis that passes through said path.

21. The fiber spreader of claim 1, wherein the physical spacing between said pins on said pin support is constant.

22. The fiber spreader of claim 20, wherein the physical spacing between said pins on said pin support is constant.

* * * * *